US012672677B2

(12) United States Patent
Liao et al.

(10) Patent No.: US 12,672,677 B2
(45) Date of Patent: Jul. 7, 2026

(54) VAPORIZER AND ELECTRONIC VAPORIZATION DEVICE WITH AIR-PRESSURE BALANCE CHANNEL

(71) Applicant: SHENZHEN SMOORE TECHNOLOGY LIMITED, Shenzhen (CN)

(72) Inventors: Junfeng Liao, Shenzhen (CN); Zhanggui Lan, Shenzhen (CN); Zhihua Wen, Shenzhen (CN); Jiewen Zou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 412 days.

(21) Appl. No.: 17/987,174

(22) Filed: Nov. 15, 2022

(65) Prior Publication Data

US 2023/0157367 A1 May 25, 2023

(30) Foreign Application Priority Data

Nov. 19, 2021 (CN) ..... 202122856219.X

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/46*** | (2020.01) |
| *A24F 40/44* | (2020.01) |

(52) U.S. Cl.

CPC ..... *A24F 40/485* (2020.01); *A24F 40/10* (2020.01); *A24F 40/42* (2020.01); *A24F 40/46* (2020.01); *A24F 40/44* (2020.01)

(58) Field of Classification Search

CPC ..... A24F 40/42; A24F 40/44; A24F 40/48; A24F 40/485; A24F 40/10

See application file for complete search history.

(56) References Cited

U.S. PATENT DOCUMENTS

| | | | |
|---|---|---|---|
| 9,308,336 | B2 | 4/2016 | Newton |
| 9,555,198 | B2 | 1/2017 | Yang et al. |
| 2016/0029700 | A1 | 2/2016 | Li et al. |
| 2016/0073694 | A1 | 3/2016 | Liu |
| 2018/0289066 | A1 | 10/2018 | Mo et al. |

(Continued)

FOREIGN PATENT DOCUMENTS

| | | | |
|---|---|---|---|
| CN | 105476073 | A | 4/2016 |
| CN | 111728281 | A | 10/2020 |

(Continued)

OTHER PUBLICATIONS

Translation of CN111743202A (Year: 2020).*

(Continued)

*Primary Examiner* — Michael H. Wilson
*Assistant Examiner* — Michael Patrick Mullen
(74) *Attorney, Agent, or Firm* — Leydig, Voit & Mayer, Ltd.

(57) ABSTRACT

A vaporizer includes: a liquid storage housing; a liquid storage member disposed in the liquid storage housing; a vent tube passing through the liquid storage member; an end cap covering an end of the liquid storage housing; and an air-pressure balance channel communicating the liquid storage member with the outside.

20 Claims, 12 Drawing Sheets

(56) References Cited

U.S. PATENT DOCUMENTS

| | | | | |
|---|---|---|---|---|
| 2019/0001077 | A1 | 1/2019 | Xu et al. | |
| 2019/0116872 | A1* | 4/2019 | Qiu | A24D 3/18 |
| 2021/0186097 | A1 | 6/2021 | Schmidt et al. | |
| 2023/0087448 | A1* | 3/2023 | He | A24F 40/48 131/329 |
| 2024/0373924 | A1* | 11/2024 | Chen | A24F 40/42 |

FOREIGN PATENT DOCUMENTS

| | | | | | |
|---|---|---|---|---|---|
| CN | 111743202 | A | * | 10/2020 | A24F 40/10 |
| CN | 212088063 | U | | 12/2020 | |
| CN | 112656032 | A | | 4/2021 | |
| CN | 213029728 | U | | 4/2021 | |
| CN | 214160108 | U | | 9/2021 | |
| CN | 214179125 | U | | 9/2021 | |

OTHER PUBLICATIONS

Translation of CN213029728U (Year: 2020).*
European Patent Office, Search Report in European Patent Application No. 22206844.7 (Apr. 19, 2023).
European Patent Office, Search Report in European Patent Application No. 22206868.6 (May 9, 2023).
European Patent Office, Search Report in European Patent Application No. 22206847.0 (May 24, 2023).
European Patent Office, Communication from the Examining Division in European Patent Application No. 22206844.7 (Apr. 1, 2025).

* cited by examiner

VAPORIZER AND ELECTRONIC VAPORIZATION DEVICE WITH AIR-PRESSURE BALANCE CHANNEL

CROSS-REFERENCE TO PRIOR APPLICATION

Priority is claimed to Chinese Patent Application No. 202122856219.X, filed on Nov. 19, 2021, the entire disclosure of which is hereby incorporated by reference herein.

FIELD

The present disclosure relates to the field of vaporization, and more specifically, to a vaporizer and an electronic vaporization device.

BACKGROUND

An existing vaporizer of an electronic vaporization device includes a liquid storage housing, a liquid storage member disposed in the liquid storage housing for absorbing and storing a vaporization liquid, a vent tube passing through the liquid storage member, and an end cap covering an opening at an upper end of the liquid storage housing. Usually, the end cap and the vent tube are sealed with an interference fit, so that a closed cavity is formed inside the vaporizer. When the vaporizer is in a high-temperature state, air in the cavity inside the vaporizer and air in the liquid storage member expand by heating to squeeze the vaporization liquid, which may cause the vaporization liquid stored in the liquid storage member to be squeezed out of a vapor convey channel of the vaporizer, resulting in liquid leakage.

SUMMARY

In an embodiment, the present invention provides a vaporizer, comprising: a liquid storage housing; a liquid storage member disposed in the liquid storage housing; a vent tube passing through the liquid storage member; an end cap covering an end of the liquid storage housing; and an air-pressure balance channel communicating the liquid storage member with the outside.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
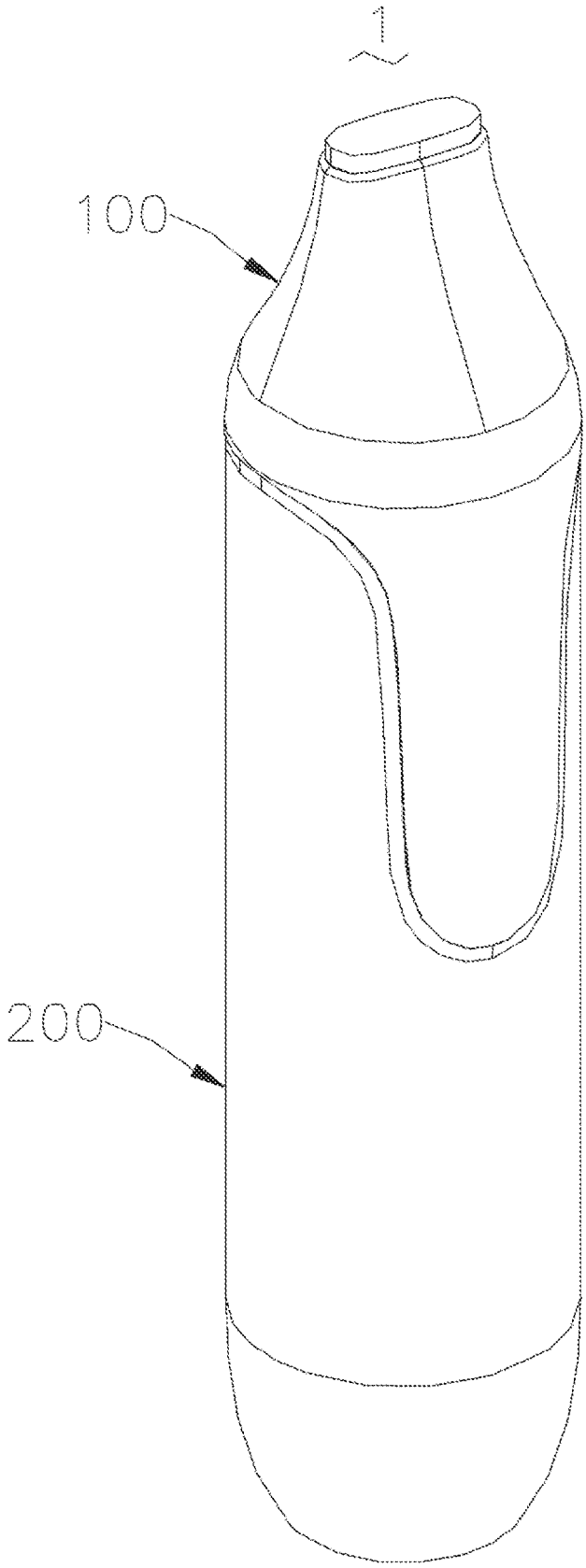
FIG. 1 is a three-dimensional schematic structural diagram of an electronic vaporization device according to a first embodiment of the present disclosure.

In an embodiment, the present invention provides an improved vaporizer and an electronic vaporization device with the vaporizer for the defects in the related art.

In an embodiment, the present invention provides a vaporizer, including a liquid storage housing, a liquid storage member disposed in the liquid storage housing, a vent tube passing through the liquid storage member, and an end cap covering an end of the liquid storage housing; and further including an air-pressure balance channel communicating the liquid storage member with the outside.

In some embodiments, an airflow channel is formed in the vent tube, and a vent hole in communication with the airflow channel is formed on the end cap; and the air-pressure balance channel is in communication with the airflow channel and the vent hole to be in communication with the outside.

In some embodiments, the end cap and the vent tube are fitted with a gap to form the air-pressure balance channel.

In some embodiments, a fitting gap between the end cap and the vent tube is 0-0.1 mm.

In some embodiments, the air-pressure balance channel is formed between an inner wall surface and/or an upper end surface and/or an outer wall surface of the vent tube and the end cap.

In some embodiments, the liquid storage member is a liquid storage cotton.

In some embodiments, a cavity is formed between a lower end surface of the end cap and an upper end surface of the liquid storage member, and the air-pressure balance channel is in communication with the cavity.

In some embodiments, the end cap includes an end cap body, and the end cap body is embedded in an end of the liquid storage housing.

In some embodiments, the vent hole runs through the end cap body in a longitudinal direction, an upper end of the vent tube extends into the vent hole, and the air-pressure balance channel is defined between an outer wall surface of the vent tube and a hole wall of the vent hole.

In some embodiments, a bottom surface of the end cap body is recessed upward to form a groove, and an upper end of the vent tube extends into the groove; and the air-pressure balance channel includes a first channel formed between an inner wall surface of the groove and the outer wall surface of the vent tube and a second channel formed between a groove bottom surface of the groove and the upper end surface of the vent tube.

In some embodiments, the end cap further includes a nesting portion extending downward from the groove bottom surface of the groove into the vent tube.

In some embodiments, the air-pressure balance channel further includes a third channel formed between the inner wall surface of the vent tube and an outer wall surface of the nesting portion.

In some embodiments, a length of the nesting portion extending into the airflow channel is less than or equal to 6.5 mm.

In some embodiments, the vaporizer further includes a liquid absorbing member disposed on the end cap, where an air outlet hole in communication with the vent hole is formed on the liquid absorbing member.

In some embodiments, the end cap has a support surface in contact with the liquid absorbing member, at least one first liquid guide groove is provided on the support surface, and the first liquid guide groove has a first end in communication with the vent hole and a second end away from the vent hole.

In some embodiments, two or more first liquid guide grooves are provided on the support surface; and the first liquid guide groove is a linear groove and extends along a radial direction of the support surface.

In some embodiments, at least one second liquid guide groove in communication with the at least one first liquid guide groove is further provided on the support surface.

In some embodiments, at least two second liquid guide grooves are provided on the support surface; and the second liquid guide groove is annular.

In some embodiments, the vaporizer further includes a heating assembly, where the liquid storage member is wrapped around a periphery of the heating assembly, and a vaporization cavity in communication with a lower end of the airflow channel is formed on the heating assembly.

The present disclosure further provides an electronic vaporization device, including the vaporizer according to any one of the foregoing.

The implementation of the present disclosure has at least the following beneficial effects. When the ambient temperature rises, the expanded air by heating inside the vaporizer may be discharged outside the vaporizer through the air-pressure balance channel, which avoids excessive squeezing of the vaporization liquid, thereby resolving the problem of liquid leakage in a high-temperature state.

In order to have a clearer understanding of the technical features, the objectives, and the effects of the present disclosure, specific implementations of the present disclosure are now illustrated in detail with reference to the accompanying drawings. Numerous specific details are set forth in the following description to provide a thorough understanding of the present disclosure. However, the present disclosure can be implemented in many other ways than described herein. A person skilled in the art may make similar improvements without departing from the intension of the present disclosure. Therefore, the present disclosure is not limited by the specific embodiments disclosed below.

In the description of the present disclosure, it needs to be understood that, orientation or position relationships indicated by terms such as "center", "longitudinal", "transverse", "length", "width", "thickness", "upper", "lower", "front", "rear", "left", "right", "vertical", "horizontal", "top", "bottom", "inner", "outer", "axial", "radial", and "circumferential" are orientation or position relationship shown based on the accompanying drawings or orientation or position relationship that the product of the present disclosure is usually placed in when it is used, and are merely used for describing the present disclosure and simplifying the description, rather than indicating or implying that the mentioned apparatus or element should have a particular orientation or be constructed and operated in a particular orientation, and therefore, should not be construed as a limitation to the present disclosure.

In addition, the terms "first" and "second" are used for descriptive purposes only and are not to be construed as indicating or implying relative importance or implicitly indicating the quantity of technical features indicated. Therefore, features defined with "first" and "second" can explicitly or implicitly include at least one of the features. In the description of the present disclosure, unless specifically defined otherwise, "a plurality of" means at least two, for example, two, three, and the like.

In the present disclosure, unless otherwise explicitly specified and defined, terms such as "mounted", "connected", "connection", and "fixed" should be understood in a broad sense. For example, the connection may be a fixed connection, a detachable connection, or an integral connection; or the connection may be a mechanical connection or an electrical connection; or the connection may be a direct connection, an indirect connection through an intermediate medium, or internal communication between two elements or mutual action relationship between two elements, unless otherwise explicitly specified. A person of ordinary skill in the art may understand the specific meanings of the foregoing terms in the present disclosure according to specific situations.

In the present disclosure, unless otherwise explicitly specified or defined, the first feature being located "above" or "below" the second feature may be the first feature being in a direct contact with the second feature, or the first feature being in an indirect contact with the second feature through an intermediate medium. In addition, that the first feature is "above", "over", or "on" the second feature may indicate that the first feature is directly above or obliquely above the second feature, or may merely indicate that the horizontal position of the first feature is higher than that of the second feature. That the first feature is "below", "under", and "beneath" the second feature may indicate that the first feature is directly below or obliquely below the second feature, or may merely indicate that the horizontal position of the first feature is lower than that of the second feature.

Figure 2:
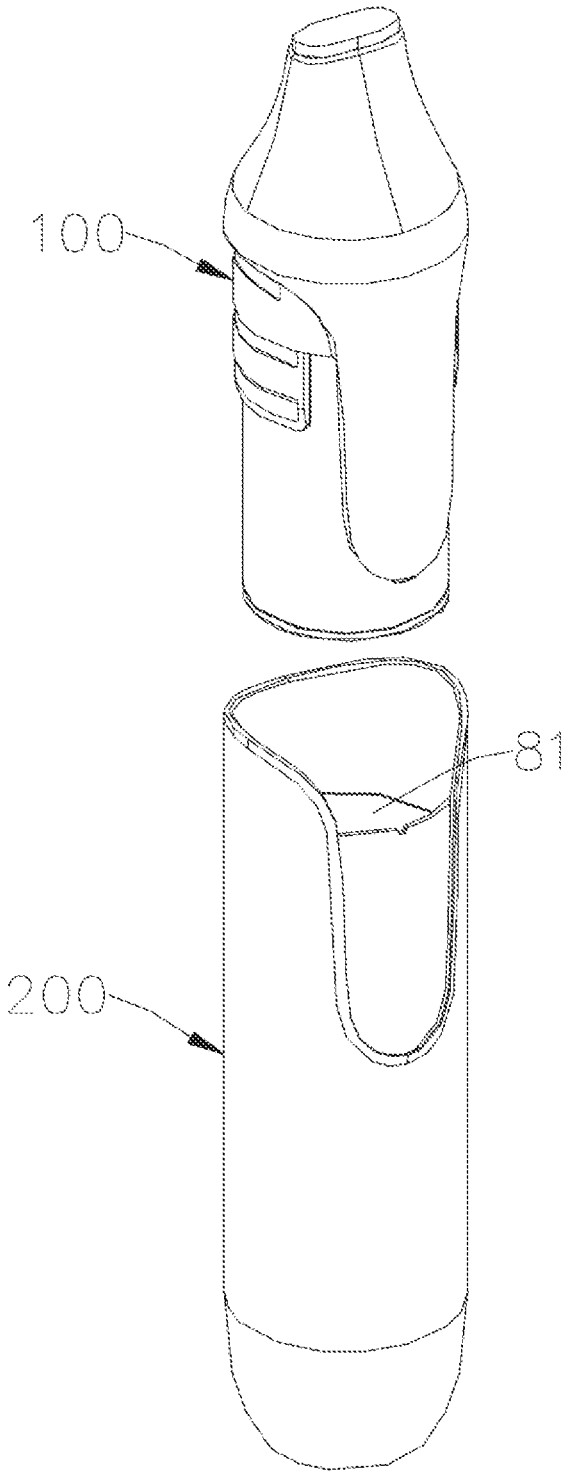
FIG. 2 is a schematic exploded structural view of the electronic vaporization device shown in FIG. 1.
Figure 3:
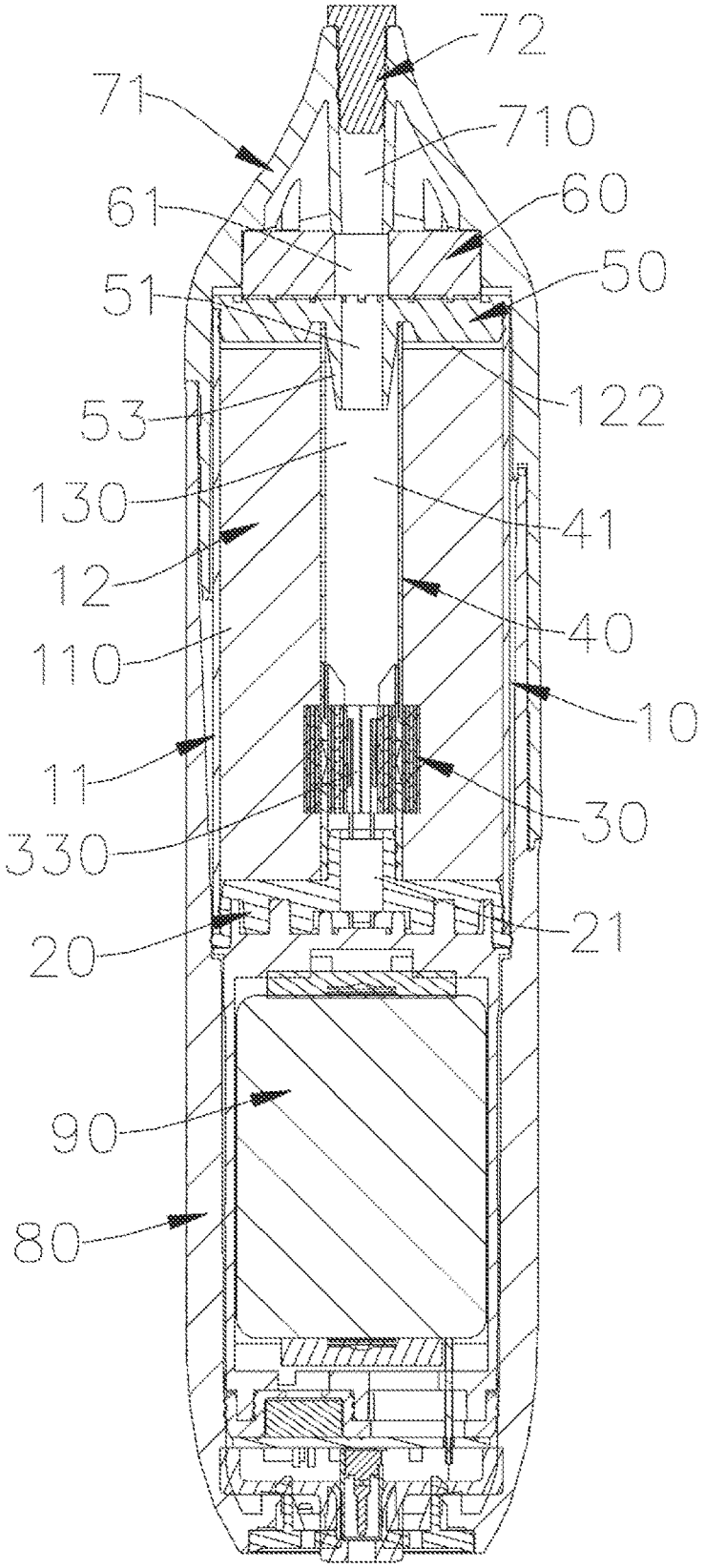
FIG. 3 is a schematic longitudinal cross-sectional structural view of the electronic vaporization device shown in FIG. 1.

FIG. 1 to FIG. 3 show an electronic vaporization device 1 according to a first embodiment of the present disclosure. In some embodiments, the electronic vaporization device 1 may be substantially cylindrical, and may include a power supply device 200 and a vaporizer 100 disposed above the power supply device 200 along a longitudinal direction. The vaporizer 100 is configured to accommodate a vaporization liquid and heat and vaporize the vaporization liquid to produce aerosols. The power supply device 200 is configured to supply power to the vaporizer 100. It may be understood that, in other embodiments, the electronic vaporization device 1 is not limited to a cylindrical shape, and may be in other shapes such as elliptical column, square column, or flat column.

The power supply device 200 may include a shell 80 and a battery 90 accommodated in the shell 80. The battery 90 is electrically connected to a heating assembly 30 of the vaporizer 100 to supply power to the heating assembly 30. The shell 80 may be substantially cylindrical. The battery 90 may be accommodated at a lower portion of the shell 80. An accommodating space 81 for accommodating the vaporizer 100 is formed at an upper portion of the shell 80.

Figure 4:
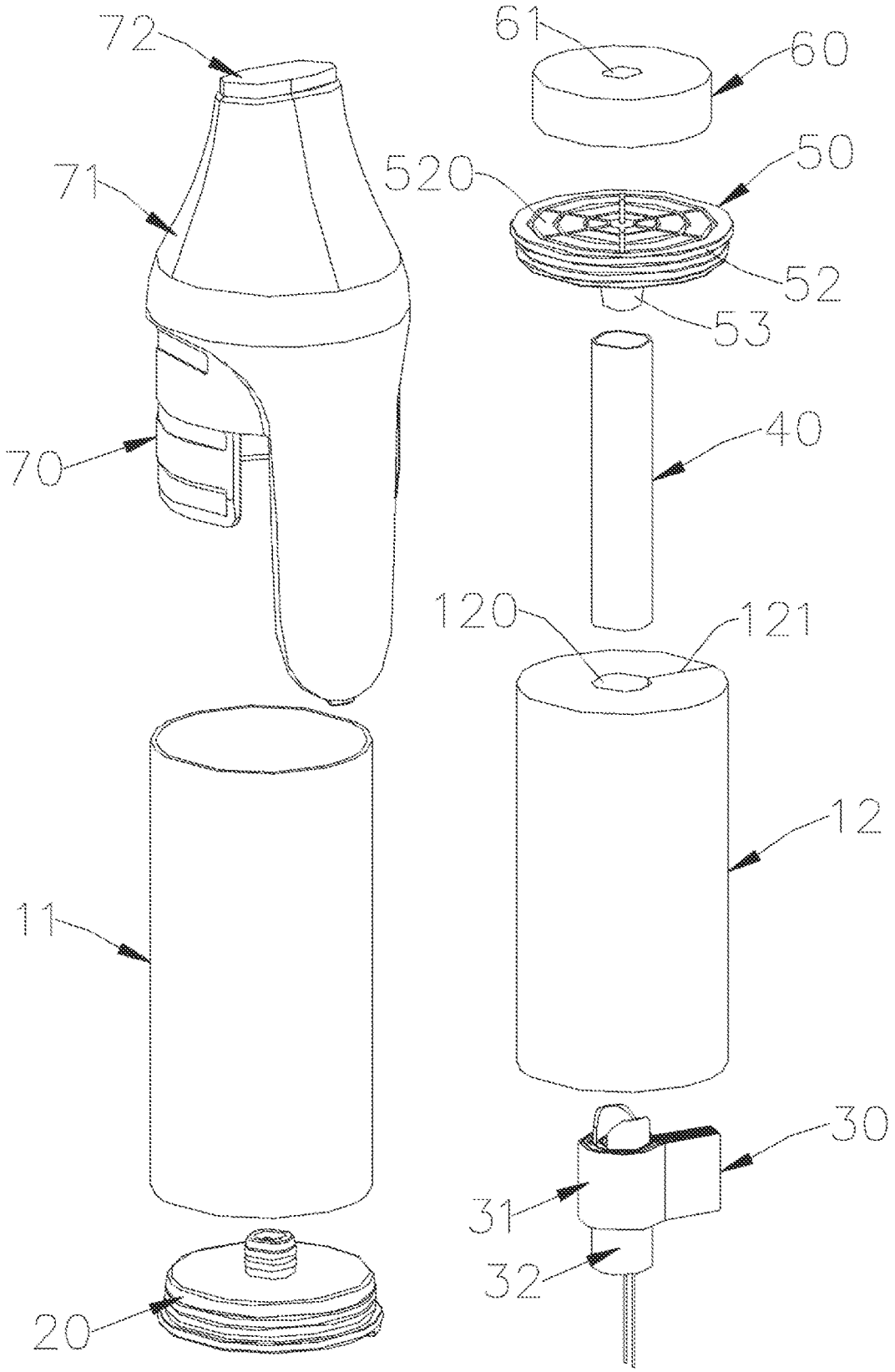
FIG. 4 is a schematic exploded structural view of a vaporizer shown in FIG. 2.

As shown in FIG. 3 and FIG. 4, in some embodiments, the vaporizer 100 may include a liquid storage device 10, a base 20, a heating assembly 30, a vent tube 40, an end cap 50, a liquid absorbing member 60, and a suction nozzle assembly 70.

The liquid storage device 10 is configured to store a vaporization liquid and may include a liquid storage housing 11. In this embodiment, the liquid storage housing 11 is in a cylindrical shape with both ends open. The vent tube 40 passes through the liquid storage housing 11 along a longitudinal direction and may be disposed coaxially with the liquid storage housing 11. An annular liquid storage space 110 is formed between an outer wall surface of the vent tube 40 and an inner wall surface of the liquid storage housing 11. An airflow channel 41 is defined by an inner wall surface of the vent tube 40. In some embodiments, the vent tube 40 may be a glass-fiber tube, so as to reduce the cost. In other embodiments, the vent tube 40 may be made of other materials such as plastic and metal.

In some embodiments, the liquid storage device 10 may also include a liquid storage member 12 disposed in the liquid storage space 110, and the liquid storage member 12 is configured to absorb and store a certain amount of vaporization liquid. The liquid storage member 12 is in an annular column shape, and a through hole 120 for the vent tube 40 to pass through is formed on the liquid storage member 12 along a longitudinal direction. The liquid storage member 12 may usually be a liquid storage cotton to absorb and store more vaporization liquid. In some embodiments, a snap opening 121 is formed on a side wall of the liquid storage member 12, so that the liquid storage member 12 is in the shape of a C-shaped cylinder, which helps snap the liquid storage member 12 to the periphery of the vent tube 40.

The heating assembly 30 is disposed in the liquid storage housing 11 and is in contact with the liquid storage member 12, and is configured to heat and vaporize the vaporization liquid stored in the liquid storage member 12 after power on. A vaporization cavity 330 may be formed on the heating assembly 30 along a longitudinal direction. The vaporization cavity 330 may be in communication with a lower end of the airflow channel 41. The heating assembly 30 may include a composite liquid-guide cotton 31 in contact with the liquid storage member 12 for absorbing the vaporization liquid from the liquid storage member 12, a heating body 33 disposed in the composite liquid-guide cotton 31 for heating and vaporizing the vaporization liquid after power on, and a heating base 32 for supporting the composite liquid-guide cotton 31.

Figure 5:
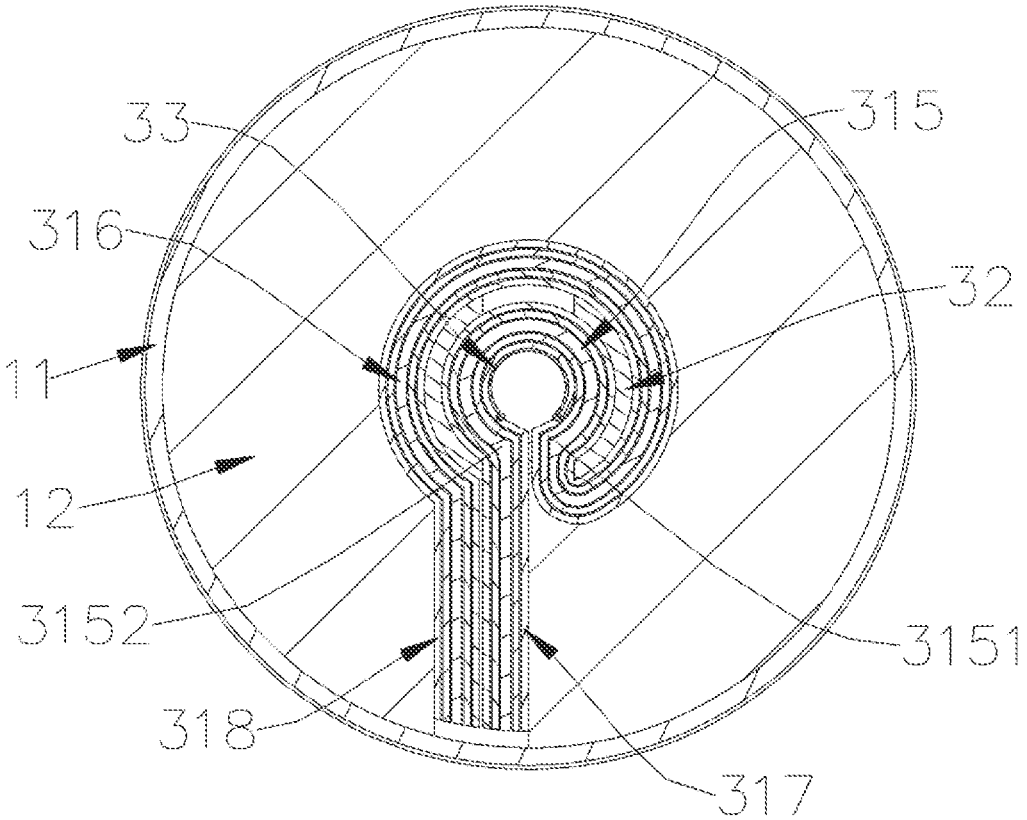
FIG. 5 is a schematic transverse cross-sectional structural view of the vaporizer shown in FIG. 2.
Figure 6:
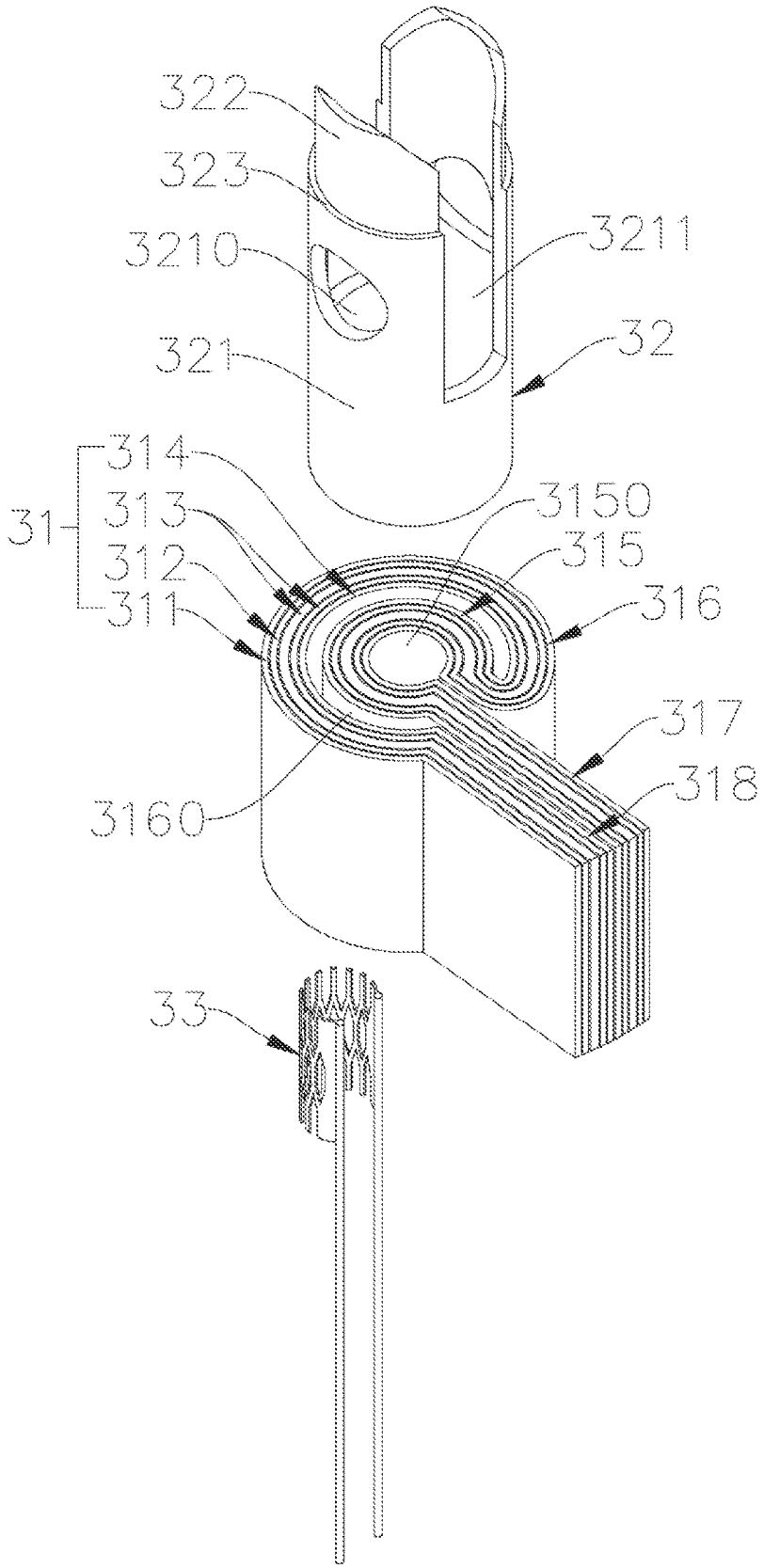
FIG. 6 is a schematic exploded structural view of a heating assembly shown in FIG. 4.

As shown in FIG. 5 and FIG. 6, in some embodiments, the composite liquid-guide cotton 31 may include at least one heat-resistant layer 311, at least one first isolation layer 312, at least one fast liquid guide layer 313, and at least one second isolation layer 314 that are stacked sequentially.

The heat-resistant layer 311 may be in contact with the liquid storage member 12 and the heating body 33 respectively, and may be made of fast-absorbing and high-temperature-resistant materials to prevent burnt smell when heated. In this embodiment, there is one heat-resistant layer 311 made of flax cotton, which has the advantages of quick liquid absorption, quick absorption and quick drying, high temperature resistance, being less likely to produce burnt smell, bacteriostasis, and the like. The flax cotton may be (45±10%) g/m2 before being impregnated. The flax cotton impregnated with the vaporization liquid has a heat-resistant temperature of 200° C. or more, preferably, 300° C. or more.

The fast liquid guide layer 313 has a high liquid-guide rate, which is higher than the heat-resistant layer 311, the first isolation layer 312, and the second isolation layer 314. In this embodiment, there are two fast liquid guide layers 313 made of wood pulp cotton, and the wood pulp cotton may be (50±10%) g/m2 before being impregnated. The method of stacking two layers of wood pulp cotton can make the liquid-guide rate higher. In other embodiments, there may be one or more fast liquid guide layers 313.

The first isolation layer 312 and the second isolation layer 314 may be made of materials that can isolate odors, guide liquid quickly, and has high liquid storage capability. The first isolation layer 312 and the second isolation layer 314 may be made of the same materials or different materials. The first isolation layer 312 and the second isolation layer 314 are respectively disposed at two opposite sides of the fast liquid guide layer 313, which can isolate odors that may be produced by the material of the fast liquid guide layer 313 itself, so that the fast liquid guide layer 313 can have a wider range of material selection, and therefore it is only necessary to consider the liquid-guide rate without worrying about whether odors will be produced when selecting the material of the fast liquid guide layer 313. In addition, the first isolation layer 312 and the second isolation layer 314 have a liquid storage capability higher than the fast liquid guide layer 313, that is, the first isolation layer 312 and the second isolation layer 314 have an amount of saturated liquid absorption per unit volume greater than the fast liquid guide layer 313. In some embodiments, the first isolation layer 312 and the second isolation layer 314 have a liquid storage capability higher than the heat-resistant layer 311, and the heat-resistant layer 311 has a liquid storage capability higher than the fast liquid guide layer 313. The first isolation layer 312 and the second isolation layer 314 can store a large amount of vaporization liquid to further avoid dry burning. In this embodiment, there is one first isolation layer 312 and one second isolation layer 314 that are made of non-woven fabric. The non-woven fabric may be (75±10%) g/m2 before being impregnated and may be 0.3-0.4 mm in thickness before being impregnated. The liquid storage amount of the composite liquid-guide cotton 31 can be increased by using 75 g of non-woven fabric. In other embodiments, the first isolation layer 312 and the second isolation layer 314 may be made of other materials such as mixed cotton (mixed by flax cotton and non-woven fabric), non-woven fabric with black spots (cottonseed), and tea fiber.

The composite liquid-guide cotton 31 may include a first liquid guide portion 315, a second liquid guide portion 316, a first extension portion 317, and a second extension portion 318.

The cross section of the first liquid guide portion 315 is an annular shape with an opening, and has a first end 3151 and a second end 3152 opposite to the first end 3151 along a circumferential direction. From the inner layer to the outer layer, the first liquid guide portion 315 includes the heat-resistant layer 311, the first isolation layer 312, the fast liquid guide layer 313, and the second isolation layer 314 in sequence. A first cavity 3150 is defined by an inner wall surface of the first liquid guide portion 315. The first cavity 3150 forms the vaporization cavity 330. The heating body 33 may be disposed on the inner wall surface of the first liquid guide portion 315. That is, the heating body 33 is disposed on the heat-resistant layer 311 of the first liquid guide portion 315. In this embodiment, the heating body 33 may be a heating sheet in a cylindrical shape. In other embodiments, the heating body 33 may be another structure such as a heating wire or a heating film in a spiral shape.

The second liquid guide portion 316 is in an annular shape and is disposed at the periphery of the first liquid guide portion 315, and may be disposed coaxially with the first liquid guide portion 315. From the outer layer to the inner layer, the second liquid guide portion 316 includes the heat-resistant layer 311, the first isolation layer 312, the fast liquid guide layer 313, and the second isolation layer 314 in sequence. The inner diameter of the second liquid guide portion 316 is larger than the outer diameter of the first liquid guide portion 315. An annular second cavity 3160 is formed between an inner wall surface of the second liquid guide portion 316 and an outer wall surface of the first liquid guide portion 315. The second cavity 3160 may be provided for the heating base 32 to pass through. That is, an inner wall surface of the heating base 32 is in contact with the second isolation layer 314 at the outermost layer of the first liquid guide portion 315, and an outer wall surface of the heating base 32 is in contact with the second isolation layer 314 at the innermost layer of the second liquid guide portion 316.

The heating base 32 may be in the shape of a round tube and may include a base body 321 and an extension portion 322 extending upward from an upper end of the base body 321. The base body 321 and the extension portion 322 have an equal inner diameter, and the base body 321 may have an outer diameter larger than the extension portion 322, so that a step surface 323 is formed at a joint of the base body 321 and the extension portion 322. A lower end of the vent tube 40 may be sleeved outside the extension portion 322. A lower end surface of the vent tube 40 may abut against the step surface 323. The outer diameter of the vent tube 40 may be equal to the outer diameter of the base body 321.

The first liquid guide portion 315 may be accommodated in the base body 321. At least one liquid inlet hole 3210 is also formed on a side wall of the base body 321, so that the vaporization liquid in the liquid storage member 12 can enter the base body 321 through the at least one liquid inlet hole 3210 to be absorbed by the first liquid guide portion 315. In this embodiment, there are two liquid inlet holes 3210 arranged symmetrically along the circumference of the base body 321.

At least one open groove 3211 may also be provided on a side wall of the heating base 32. The open groove 3211 may extend downward along an axial direction from an upper end surface of the extension portion 322. The first end 3151 and the second end 3152 of the first liquid guide portion 315 may pass through the open groove 3211. In addition, the open groove 3211 also has the function of communicating the liquid storage member 12 and the first liquid guide portion 315. In this embodiment, there are two open grooves 3211 arranged symmetrically along the circumference of the heating base 32, and the open groove 3211 and the liquid inlet hole 3210 may be provided at an included angle of 90 degrees along a circumferential direction of the heating base 32.

The first end 3151 of the first liquid guide portion 315 passes through the open groove 3211 and is connected to one end of the second liquid guide portion 316 in a circumferential direction, and the second end 3152 of the first liquid guide portion 315 passes through the open groove 3211 and extends outward along a radial direction to form the first extension portion 317. The other end of the second liquid guide portion 316 in the circumferential direction is connected to the second extension portion 318, and the extension direction of the second extension portion 318 may be the same as the extension direction of the first extension portion 317. The second extension portion 318 and the first extension portion 317 may be assembled together and then snapped into the snap opening 121 of the liquid storage member 12.

When the heating assembly 30 is assembled, the sheet-shaped composite liquid-guide cotton may be first wrapped around the heating body 33 to form the first liquid guide portion 315. Then, the first liquid guide portion 315 wrapping the heating body 33 is inserted downward into the heating base 32 through an upper end opening of the heating base 32, the second end 3152 of the first liquid guide portion 315 extends outward from the open groove 3211 in a radial direction to form the first extension portion 317, the first end 3151 of the first liquid guide portion 315 passes through the open groove 3211 and is wound around the heating base 32 to form the second liquid guide portion 316, and then the other end of the second liquid guide portion 316 is attached to the first extension portion 317 to form the second extension portion 318. Finally, the liquid storage member 12 is wrapped around the heating assembly 30, and the first extension portion 317 and the second extension portion 318 that are attached together are snapped into the snap opening 121 of the liquid storage member 12.

In this embodiment, the second liquid guide portion 316, the first extension portion 317, and the second extension portion 318 of the composite liquid-guide cotton 31 are all in contact with the liquid storage member 12, so that the contact area of the composite liquid-guide cotton 31 and the liquid storage member 12 is greatly increased, thereby greatly increasing the liquid-absorbing rate of the composite liquid-guide cotton 31.

Further, as shown in FIG. 3 and FIG. 4, the base 20 and the end cap 50 respectively cover both ends of the liquid storage space 110 and may be respectively made of elastic materials such as silica gel, which is conducive to sealing and blocking of both ends of the liquid storage space 110, so as to reduce liquid leakage. Specifically, the base 20 may be embedded at a lower end opening of the liquid storage housing 11, that is, an opening of an end of the liquid storage housing 11 close to the battery 90. The base 20 may be configured to support the liquid storage member 12 and the heating assembly 30. An air guide hole 21 in communication with the vaporization cavity 330 may be formed on the base 20 along a longitudinal direction. The end cap 50 may be embedded at an upper end opening of the liquid storage housing 11, that is, an opening of an end of the liquid storage housing 11 close to the suction nozzle assembly 70. A vent hole 51 in communication with an upper end of the airflow channel 41 may be formed on the end cap 50 along a longitudinal direction.

In some embodiments, the end cap 50 may include an end cap body 52 and a nesting portion 53 extending downward from a lower end surface of the end cap body 52, and the end cap body 52 and the nesting portion 53 may be disposed coaxially. The end cap body 52 is embedded in the upper end opening of the liquid storage housing 11, and an outer wall surface of the end cap body 52 may be fitted with an inner wall surface of the liquid storage housing 11 in a sealed manner to avoid liquid leakage. A support surface 520 for supporting the liquid absorbing member 60 is formed on an upper end surface of the end cap body 52. An annular cavity 122 may be formed between the lower end surface of the end cap body 52 and the upper end surface of the liquid storage member 12, which can prevent the end cap body 52 from squeezing the liquid storage member 12 to cause liquid leakage. In other embodiments, the lower end surface of the end cap body 52 may be in contact with the upper end surface of the liquid storage member 12.

The nesting portion 53 is inserted downward into the airflow channel 41 for assembly. In this embodiment, an outer wall surface of the nesting portion 53 is fitted with the inner wall surface of the vent tube 40 in a sealed manner, and the lower end surface of the end cap body 52 is fitted with the upper end surface of the vent tube 40 in a sealed manner. The outer diameter of the lower end of the nesting portion 53 may be gradually increased from bottom to top, so as to form a guide slope that facilitates insertion into the airflow channel 41. By reducing the length of the nesting portion 53 extending into the airflow channel 41, the length of the vaporized gas adsorbed by a hole wall of the vent hole 51 can be reduced, the loss of aroma and sweetness of the vaporized gas can be reduced, and the accumulation of condensate in the vent hole 51 can be reduced. In some embodiments, a length of the nesting portion 53 extending into the airflow channel 41 is less than or equal to 6.5 mm.

The liquid absorbing member 60 is supported on the support surface 520 of the end cap 50 and is in contact with the support surface 520, and is configured to absorb the condensate accumulated in the vent hole 51, so as to prevent a smoker from inhaling the condensate accumulated in the vent hole 51. An air outlet hole 61 in communication with the vent hole 51 may be formed on the liquid absorbing member 60 along a longitudinal direction. The liquid absorbing member 60 is usually a liquid absorbing cotton to absorb and store more condensate.

Figure 7:
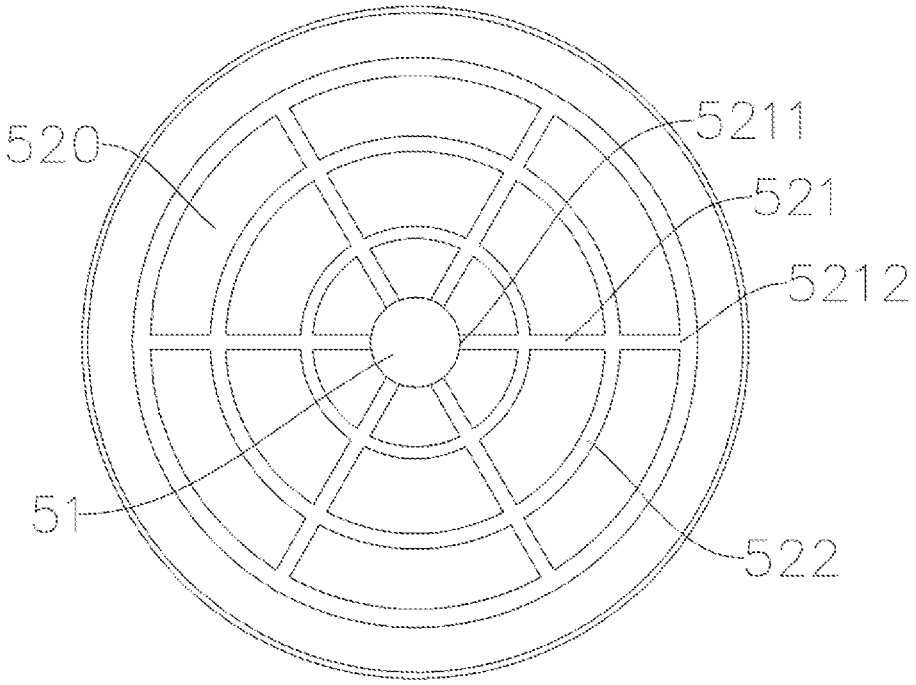
FIG. 7 is a schematic top structural view of an end cap shown in FIG. 4.

As shown in FIG. 7, at least one first liquid guide groove 521 may be provided on the support surface 520, and the first liquid guide groove 521 has a first end 5211 and a second end 5212 opposite to the first end 5211. The first end 5211 of the first liquid guide groove 521 is in communication with the vent hole 51, and the second end 5212 of the first liquid guide groove 521 extends away from the vent hole 51. The condensate in the vent hole 51 may be drained through the first liquid guide groove 521 and then absorbed by the liquid absorbing member 60 in contact with the first liquid guide groove 521, so as to increase the liquid absorbing rate of the liquid absorbing member 60. Preferably, there are two or more first liquid guide grooves 521, and the second end 5212 of the first liquid guide groove 521 extends at least to communicate with an outer edge of a bottom surface of the liquid absorbing member 60, so that the condensate in the vent hole 51 is drained to the entire bottom surface of the liquid absorbing member 60.

The shape of the first liquid guide groove 521 may not be limited. For example, the first liquid guide groove 521 may be a linear groove or a curved groove. In this embodiment, the first liquid guide groove 521 is a linear groove, the first liquid guide groove 521 may extend along a radial direction of the support surface 520, and the longest length of the first liquid guide groove 521 is greater than or equal to the radius of the liquid absorbing member 60. Preferably, the quantity of the first liquid guide groove 521 is directly proportional to the cross-sectional area of the vent hole 51, that is, a larger cross-sectional area of the vent hole 51 indicates that more first liquid guide grooves 521 are required, resulting in a better liquid guide effect. The two or more first liquid guide grooves 521 may be evenly distributed along a circumferential direction of the support surface 520, so as to drain the condensate in the vent hole 51 to the entire bottom surface of the liquid absorbing member 60.

Further, at least one second liquid guide groove 522 in communication with the at least one first liquid guide groove 521 may be further provided on the support surface 520. The condensate in the vent hole 51 is drained to the first liquid guide groove 521 and the second liquid guide groove 522 in communication with the first liquid guide groove 521, and then absorbed by the liquid absorbing member 60 in contact with the first liquid guide groove 521 and the second liquid guide groove 522. In this embodiment, the second liquid guide groove 522 is in an annular shape, and each of the annular second liquid guide grooves 522 is in communication with the two or more first liquid guide grooves 521. Preferably, there may be two or more second liquid guide grooves 522. When there are a plurality of second liquid guide grooves 522, the distance between every two adjacent second liquid guide grooves 522 in the plurality of second liquid guide grooves 522 gradually decreases in the direction away from the vent hole 51, which can help the condensate in the vent hole 51 to spread out to the periphery more quickly to be absorbed by the liquid absorbing member 60. In this embodiment, the maximum radius of the at least two second liquid guide grooves 522 is equal to the longest length of the first liquid guide groove 521. It may be understood that, in other embodiments, the support surface 520 may only be provided with the first liquid guide groove 521 without the second liquid guide groove 522.

Further, as shown in FIG. 3, the suction nozzle assembly 70 includes a suction nozzle 71 disposed on an upper end of the liquid storage housing 11, and an inhalation channel 710 in communication with the air outlet hole 61 is formed on the suction nozzle 71 in a longitudinal direction. An upper portion of the liquid storage housing 11, the end cap 50, and the liquid absorbing member 60 may all be accommodated in a lower portion of the suction nozzle 71.

Herein, the air guide hole 21, the vaporization cavity 330, the airflow channel 41, the vent hole 51, the air outlet hole 61, and the inhalation channel 710 are in communication from bottom to top to form a vapor convey channel 130. The air guide hole 21 forms an air inlet channel of the vapor convey channel 130 for introducing outside air. The airflow channel 41, the vent hole 51, the air outlet hole 61, and the inhalation channel 710 together form an air outlet channel of the vapor convey channel 130 for discharging the vaporized gas. The outside air enters from the air inlet channel and flows upward to the vaporization cavity 330 to mix with the aerosols produced by heating the vaporization liquid by the heating assembly 30, and the mixed vaporized gas is then discharged through the air outlet channel to be inhaled by a smoker.

In some embodiments, the suction nozzle assembly 70 may also include a sealing plug 72. The sealing plug 72 may be made of elastic materials such as silica gel. The sealing plug 72 is detachably plugged in an upper end of the inhalation channel 710 and may be configured to seal and block the inhalation channel 710 when the vaporizer 100 is not in use, so as to prevent dust from entering the inhalation channel 710.

Figure 8:
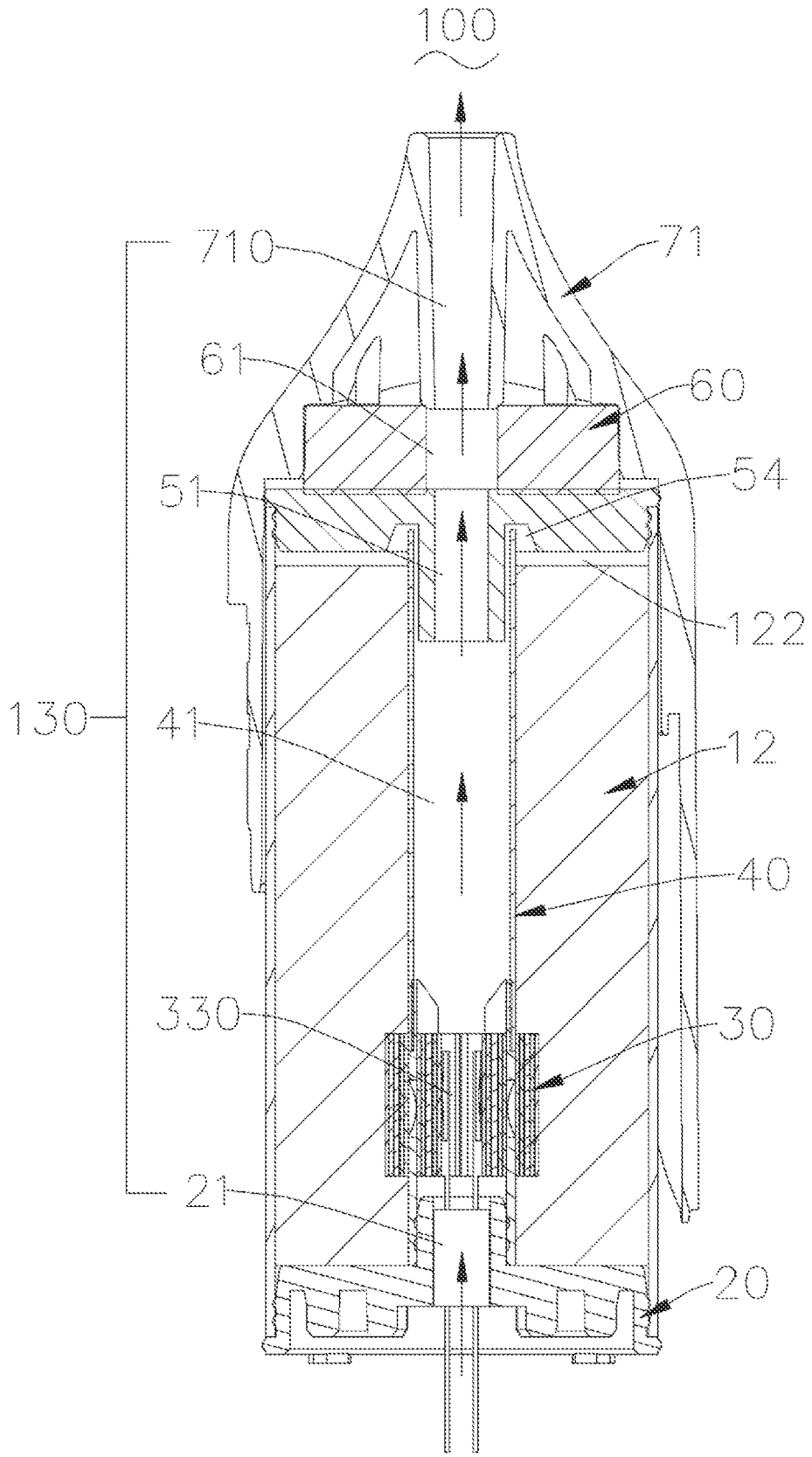
FIG. 8 is a schematic longitudinal cross-sectional structural view of a vaporizer according to a second embodiment of the present disclosure.
Figure 9:
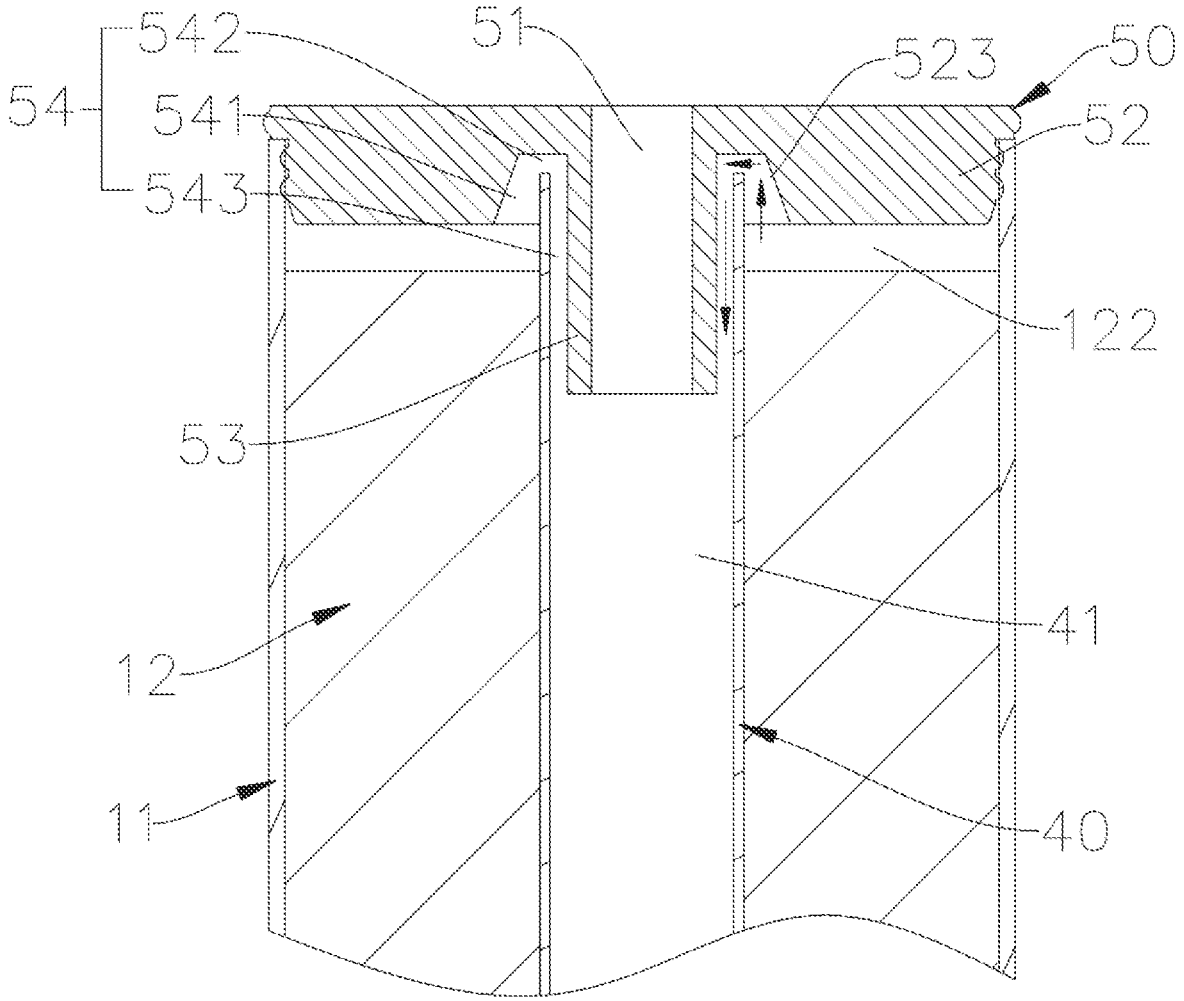
FIG. 9 is a schematic partial structural view of the vaporizer shown in FIG. 8.

FIG. 8 and FIG. 9 show a vaporizer 100 in a second embodiment of the present disclosure. The main difference from the first embodiment lies in that the liquid storage member 12 in this embodiment is in communication with the outside through an air-pressure balance channel 54. When the ambient temperature rises, the expanded air by heating inside the vaporizer 100 may be discharged outside the vaporizer 100 through the air-pressure balance channel 54, which avoids excessive squeezing of the vaporization liquid, thereby resolving the problem of liquid leakage in a high-temperature state.

Based on the above, in this embodiment, the air guide hole 21, the vaporization cavity 330, the airflow channel 41, the vent hole 51, the air outlet hole 61, and the inhalation channel 710 are in communication from bottom to top to form the vapor convey channel 130. The air-pressure balance channel 54 is in communication with the vapor convey channel 130 to be in communication with the outside.

Preferably, the air-pressure balance channel 54 may be formed by fitting the end cap 50 and the vent tube 40 with a gap, so that the liquid storage member 12 is in communication with the airflow channel 41 and the vent hole 51 through the air-pressure balance channel 54, and is further in communication with the outside. The air-pressure balance channel 54 is formed by reserving a fitting gap between the end cap 50 and the vent tube 40, leading to a simple design, and avoiding operations such as opening holes and slots on the components and parts. In some embodiments, a fitting gap between the end cap 50 and the vent tube 40 may be 0-0.1 mm.

Specifically, in this embodiment, the end cap 50 may include an end cap body 52 and a nesting portion 53 extending downward from the end cap body 52 into the airflow channel 41. The vent hole 51 runs through the end cap body 52 and the nesting portion 53 along a longitudinal direction, and may be provided coaxially with the end cap body 52 and the nesting portion 53. An annular cavity 122 may be formed between the lower end surface of the end cap body 52 and the upper end surface of the liquid storage member 12. A bottom surface of the end cap body 52 is recessed upward to form a groove 523, and the groove 523 may be provided coaxially with the end cap body 52. The nesting portion 53 may be formed by extending a groove bottom surface of the groove 523 downward.

The upper end of the vent tube 40 may be accommodated in the groove 523. A first fitting gap is provided between the inner wall surface of the groove 523 and the outer wall surface of the vent tube 40. The first fitting gap forms a first channel 541 in communication with the cavity 122. A second fitting gap is provided between the groove bottom surface of the groove 523 and the upper end surface of the vent tube 40. The second fitting gap forms a second channel 542 in communication with the first channel 541. A third fitting gap is provided between the outer wall surface of the nesting portion 53 and the inner wall surface of the vent tube 40. The third fitting gap forms a third channel 543 in communication with the second channel 542. The first channel 541, the second channel 542, and the third channel 543 are in communication in sequence to form the air-pressure balance channel 54 that communicates the cavity 122 with the airflow channel 41. When the ambient temperature rises, the expanded air by heating inside the cavity 122 and the expanded air by heating inside the liquid storage member 12 are discharged into the airflow channel 41 sequentially through the first channel 541, the second channel 542, and the third channel 543, and then discharged outside the vaporizer 100 through the vapor convey channel 130.

Figure 10:
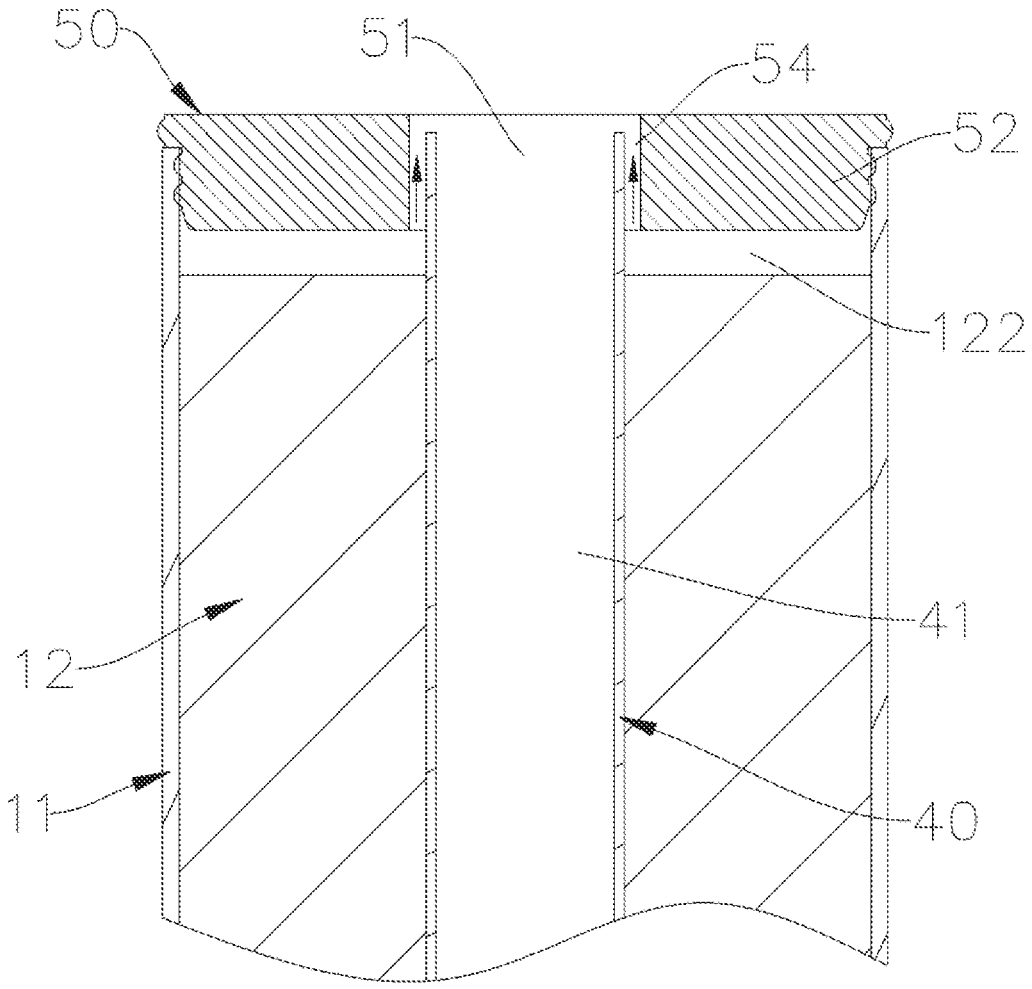
FIG. 10 is a schematic partial cross-sectional structural view of a vaporizer according to a third embodiment of the present disclosure.

FIG. 10 shows a vaporizer 100 in a third embodiment of the present disclosure. The main difference from the second embodiment lies in that the end cap 50 in this embodiment includes only the end cap body 52. Specifically, the vent hole 51 runs through the end cap body 52 in a longitudinal direction, and the upper end of the vent tube 40 extends into the vent hole 51 and is in communication with the vent hole 51. A fitting gap is provided between the outer wall surface of the vent tube 40 and the hole wall of the vent hole 51. The fitting gap forms the air-pressure balance channel 54 that communicates the cavity 122 with the vent hole 51.

Figure 11:
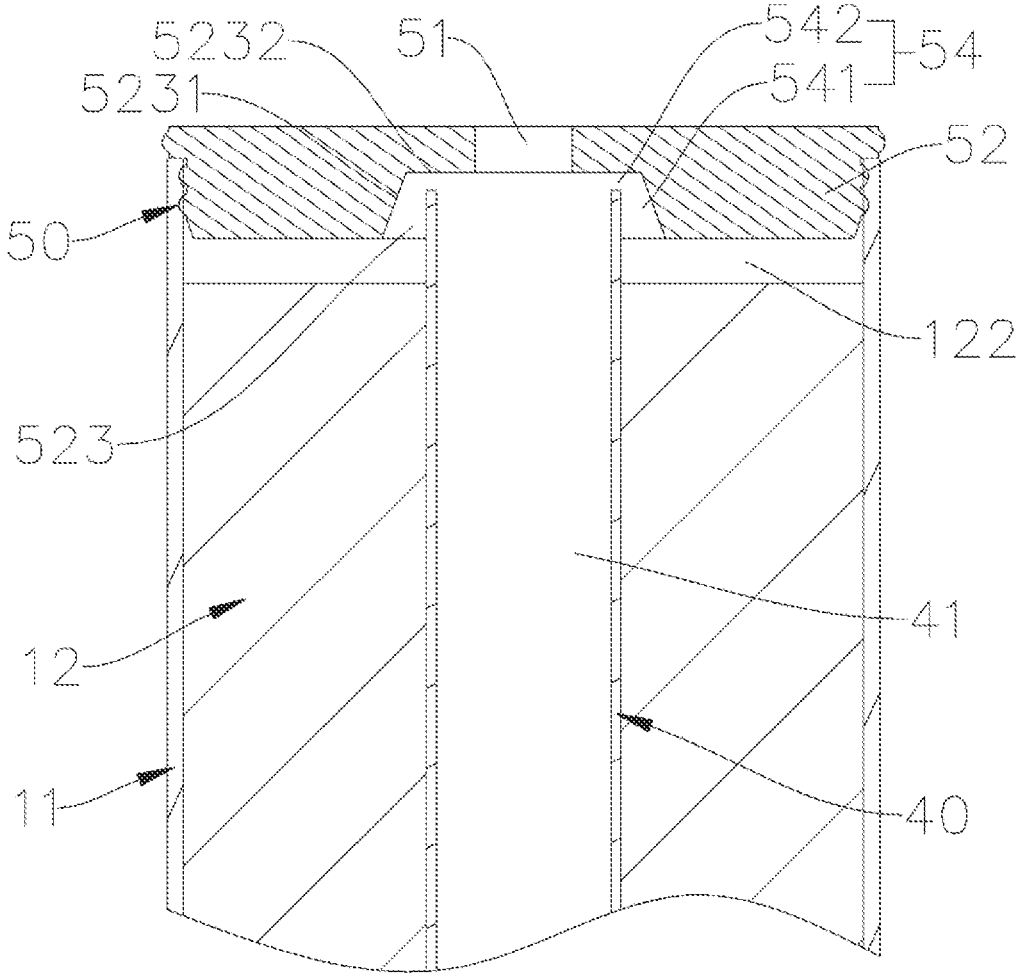
FIG. 11 is a schematic partial cross-sectional structural view of a vaporizer according to a fourth embodiment of the present disclosure.

FIG. 11 shows a vaporizer 100 in a fourth embodiment of the present disclosure. The main difference from the second embodiment lies in that the end cap 50 in this embodiment includes only the end cap body 52. Specifically, the vent hole 51 extends downward from the upper end surface of the end cap body 52, the bottom surface of the end cap body 52 is recessed upward to form the groove 523 in communication with the vent hole 51, and the outer diameter of the groove 523 is greater than the outer diameter of the vent hole 51. The upper end of the vent tube 40 may be accommodated in the groove 523. A first fitting gap is provided between the inner wall surface 5231 of the groove 523 and the outer wall surface of the vent tube 40. The first fitting gap forms a first channel 541 in communication with the cavity 122. A second fitting gap is provided between the groove bottom surface 5232 of the groove 523 and the upper end surface of the vent tube 40. The second fitting gap forms a second channel 542 in communication with the first channel 541. The first channel 541 and the second channel 542 are in communication in sequence to form the air-pressure balance channel 54 that communicates the cavity 122 with the airflow channel 41 and the vent hole 51.

Figure 12:
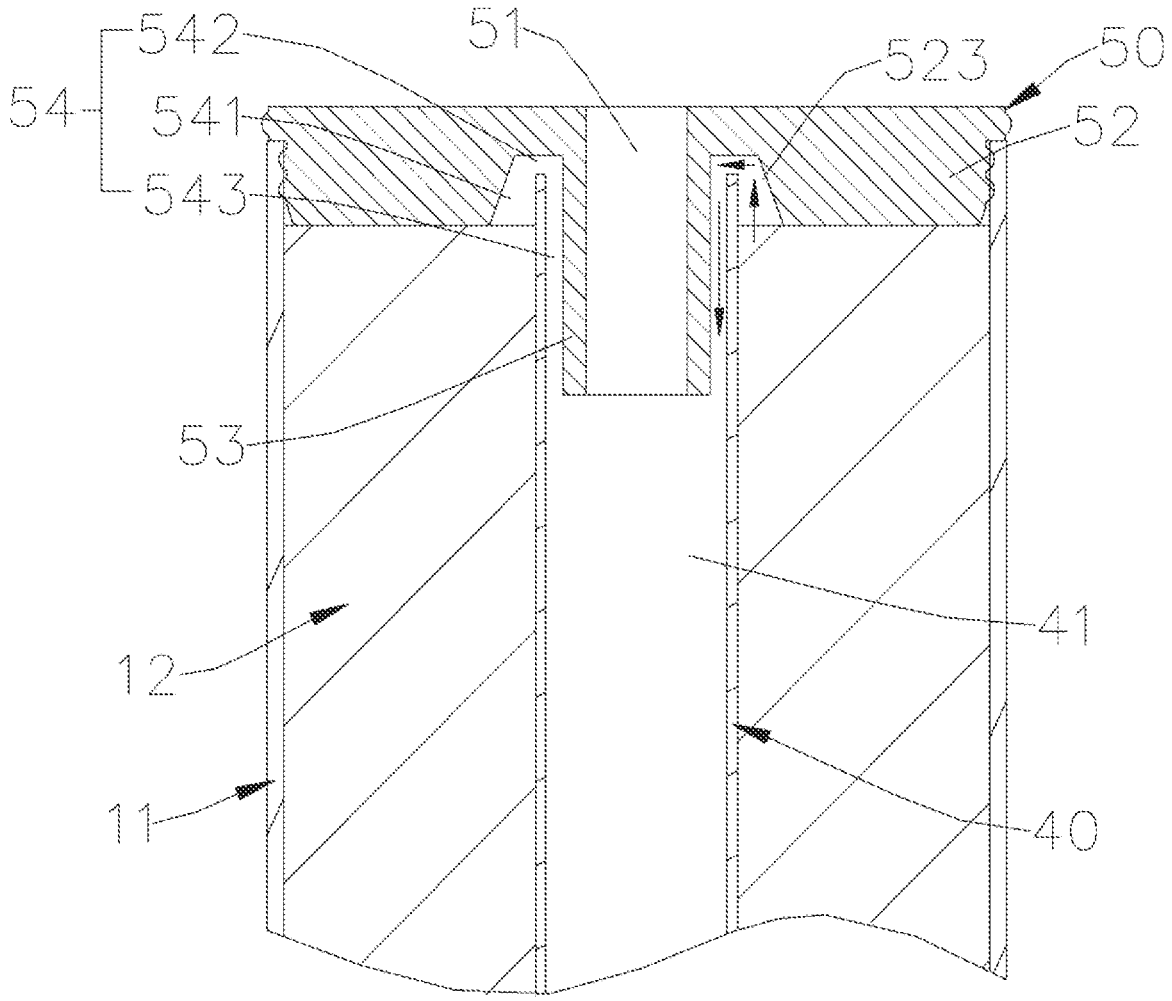
FIG. 12 is a schematic partial cross-sectional structural view of a vaporizer according to a fifth embodiment of the present disclosure.

FIG. 12 shows a vaporizer 100 in a fifth embodiment of the present disclosure. The main difference from the second embodiment lies in that, in this embodiment, the lower end surface of the end cap body 52 is in contact with the upper end surface of the liquid storage member 12, that is, no cavity 122 is formed between the lower end surface of the end cap body 52 and the upper end surface of the liquid storage member 12. Correspondingly, in this embodiment, the first channel 541 of the air-pressure balance channel 54 is in communication with the liquid storage member 12. When the ambient temperature rises, the expanded air by heating inside the liquid storage member 12 is discharged into the airflow channel 41 sequentially through the first channel 541, the second channel 542, and the third channel 543, and then discharged outside the vaporizer 100 through the vapor convey channel 130.

It may be understood that the foregoing technical features may be used in any combination without limitation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a liquid storage housing;

a liquid storage member disposed in the liquid storage housing, the liquid storage member forming a through hole;

a vent tube passing through the through hole of the liquid storage member, the vent tube having a vent hole;

an end cap covering an end of the liquid storage housing; and an air-pressure balance channel communicating the liquid storage member with an outside, wherein the end cap comprises an end cap body and a nesting portion, wherein the vent hole runs through the end cap body in a longitudinal direction so as to be coaxial with the nesting portion, wherein a portion of a bottom surface of the end cap body that faces the liquid storage member is recessed upward in the longitudinal direction to in part form a groove in the end cap body, the groove having a groove bottom surface, and wherein the nesting portion is formed in part by extending the groove bottom surface downward in the longitudinal direction.

2. The vaporizer of claim 1, wherein an airflow channel is formed in the vent tube and the vent hole, which is in communication with the airflow channel, is formed on the end cap, and wherein the air-pressure balance channel is in communication with the airflow channel and the vent hole to be in communication with the outside.

3. The vaporizer of claim 2, wherein the end cap and the vent tube are fitted with a gap to form the air-pressure balance channel.

4. The vaporizer of claim 3, wherein the gap between the end cap and the vent tube is 0 to 0.1 mm in length.

5. The vaporizer of claim 3, wherein the air-pressure balance channel is formed between a first surface of the vent tube and a second surface of the end cap, and wherein the first surface of the vent tube comprises: an inner wall surface, an upper end surface, or an outer wall surface.

6. The vaporizer of claim 1, wherein the liquid storage member comprises a liquid storage cotton.

7. The vaporizer of claim 1, wherein a cavity is formed between a lower end surface of the end cap and an upper end surface of the liquid storage member, and wherein the air-pressure balance channel is in communication with the cavity.

8. The vaporizer of claim 2, wherein the end cap body is embedded in the end of the liquid storage housing.

9. The vaporizer of claim 8, wherein the upper end of the vent tube extends into the groove, and wherein the air-pressure balance channel comprises a first channel formed between the inner wall surface of the groove and the outer wall surface of the vent tube and a second channel formed between the groove bottom surface of the groove and an upper end surface of the vent tube.

10. The vaporizer of claim 9, wherein the nesting portion extends downward from the groove bottom surface of the groove into the vent tube.

11. The vaporizer of claim 10, wherein the air-pressure balance channel further comprises a third channel formed between the inner wall surface of the vent tube and an outer wall surface of the nesting portion.

12. The vaporizer of claim 10, wherein a length of the nesting portion extending into the airflow channel is less than or equal to 6.5 mm.

13. The vaporizer of claim 2, further comprising:

a liquid absorbing member disposed on the end cap, wherein an air outlet hole in communication with the vent hole is formed on the liquid absorbing member.

14. The vaporizer of claim 13, wherein the end cap has a support surface in contact with the liquid absorbing member, at least one first liquid guide groove is provided on the support surface, and the first liquid guide groove has a first end in communication with the vent hole and a second end away from the vent hole.

15. The vaporizer of claim 14, wherein the at least one first liquid guide groove comprises two or more first liquid guide grooves, wherein the two or more first liquid guide grooves are provided on the support surface, and wherein one first liquid guide groove of the two or more first liquid guide grooves comprises a linear groove and extends along a radial direction of the support surface.

16. The vaporizer of claim 14, wherein at least one second liquid guide groove in communication with the at least one first liquid guide groove is further provided on the support surface.

17. The vaporizer of claim 16, wherein at least two second liquid guide grooves are provided on the support surface, and wherein at least one second liquid guide groove of the at least two second liquid guide grooves is annular.

18. The vaporizer of claim 2, further comprising:

a heating assembly, wherein the liquid storage member is wrapped around a periphery of the heating assembly, and wherein a vaporization cavity in communication with a lower end of the airflow channel is formed on the heating assembly.

19. An electronic vaporization device, comprising:

the vaporizer of claim 1.

20. The vaporizer of claim 1, wherein the air-pressure balance channel is configured to direct pressurized air sequentially from a cavity between the end cap body and the liquid storage member upward in the longitudinal direction along the vent tube, laterally around a periphery of the vent tube, downward in the longitudinal direction between the vent tube and the nesting portion, and upward through the vent hole.

* * * * *